US009961956B2

(12) United States Patent
Williams

(10) Patent No.: US 9,961,956 B2
(45) Date of Patent: May 8, 2018

(54) MODULAR SANDAL

(71) Applicant: Robert Williams, Chicago, IL (US)

(72) Inventor: Robert Williams, Chicago, IL (US)

( * ) Notice: Subject to any disclaimer, the term of this patent is extended or adjusted under 35 U.S.C. 154(b) by 0 days. days.

(21) Appl. No.: 15/451,570

(22) Filed: Mar. 7, 2017

(65) Prior Publication Data

US 2017/0258174 A1 Sep. 14, 2017

Related U.S. Application Data

(60) Provisional application No. 62/305,730, filed on Mar. 9, 2016.

(51) Int. Cl.

| | |
|---|---|
| ***A43B 3/12*** | (2006.01) |
| ***A43B 3/24*** | (2006.01) |
| ***A43B 3/00*** | (2006.01) |
| ***A43B 3/10*** | (2006.01) |

(52) U.S. Cl.

CPC ..... *A43B 3/24* (2013.01); *A43B 3/0078* (2013.01); *A43B 3/10* (2013.01); *A43B 3/108* (2013.01); *A43B 3/122* (2013.01); *A43B 3/128* (2013.01)

(58) Field of Classification Search

CPC ..... A43B 3/10; A43B 3/108; A43B 3/122; A43B 3/128; A43B 3/24; A43B 3/242

USPC ..... 36/11.5, 101

See application file for complete search history.

(56) References Cited

U.S. PATENT DOCUMENTS

| | | | | |
|---|---|---|---|---|
| 4,172,330 | A * | 10/1979 | Kao | A43B 3/103 36/101 |
| 7,222,442 | B2 * | 5/2007 | Hillyer | A43B 3/103 36/10 |
| 8,171,654 | B2 | 5/2012 | Rudd et al. | |
| 8,434,246 | B2 | 5/2013 | Enderson | |
| 8,448,351 | B2 * | 5/2013 | Aveni | A43B 3/103 36/101 |
| 9,072,338 | B1 | 7/2015 | Kostecky | |
| 2007/0245597 | A1 * | 10/2007 | Krutilek | A43B 3/103 36/101 |
| 2009/0044423 | A1 * | 2/2009 | Amsterdam | A43B 3/103 36/11.5 |
| 2009/0260260 | A1 | 10/2009 | Whitaker et al. | |
| 2011/0214311 | A1 * | 9/2011 | Stonisch | A43B 3/12 36/101 |
| 2013/0019496 | A1 * | 1/2013 | Mizrahi-Shapiro | A43B 1/0027 36/11.5 |
| 2014/0123448 | A1 | 5/2014 | Tussy | |

* cited by examiner

*Primary Examiner* — Ted Kavanaugh
(74) *Attorney, Agent, or Firm* — Global Intellectual Property Agency, LLC; Jordan Sworen

(57) ABSTRACT

A modular sandal. The modular sandal includes a sole having an upper side and a lower side. Slots disposed on the lower side include an interior wall and a width. Channels extending from the lower side of the sole through the upper side of the sole include a diameter. Each of the channels is positioned within one of the slots. A strap including locking tabs is pivotally affixed to the sole. Each locking tab is configured to pivot between a locked position and an unlocked position. Each locking tab is configured to pass through each channel when in an unlocked position. Each locking tab frictionally engages the interior wall of each slot when in a locked position, thereby anchoring the strap to the sole.

10 Claims, 2 Drawing Sheets

MODULAR SANDAL

CROSS REFERENCE TO RELATED APPLICATIONS

This application claims the benefit of U.S. Provisional Application No. 62/305,730 filed on Mar. 9, 2016. The above identified patent application is herein incorporated by reference in its entirety to provide continuity of disclosure.

FIELD OF THE INVENTION

The present invention relates to open toe footwear. More specifically, the present invention provides a modular sandal having a removable and interchangeable strap portion.

BACKGROUND OF THE INVENTION

Many individuals wear sandals and other types of open toe footwear. Such footwear typically only includes one color or pattern. Oftentimes the owner of the sandal has clothing that does not aesthetically match the sandal, so the user may forgo to wear the sandal when wearing those close, decreasing the usability of the sandal. In order to match multiple outfits, individuals often need to purchase multiple pairs of sandals, which can be expensive and time-consuming. It is therefore desirable to provide a modular sandal having removable and interchangeable straps, so that the wearer may match different colored or patterned straps with different colored or patterned soles according to their preferences.

Devices have been disclosed in the known art that relate to customizable open toe footwear. These include devices that have been patented and published in patent application publications. The devices disclosed in the known art have several known drawbacks. These devices typically include a variety of small fasteners that may be easily misplaced, rendering the footwear useless. Additionally, the devices in the known art fail to provide a strap locking mechanism that is integral to the strap.

In light of the devices disclosed in the known art, it is submitted that the present invention substantially diverges in design elements from the prior art and consequently it is clear that there is a need in the art for an improvement to existing customizable footwear. In this regard the present invention substantially fulfills these needs.

SUMMARY OF THE INVENTION

In view of the foregoing disadvantages inherent in the known types of sandals now present in the prior art, the present invention provides a modular sandal wherein the same can be utilized for providing the user with customizable footwear having interchangeable straps. The modular sandal includes a sole having an upper side and a lower side; a plurality of slots disposed on the lower side, each slot having an interior wall and a width; a plurality of channels extending from the lower side through the upper side of the sole, each channel having a diameter, each channel positioned within one of the plurality of slots; and a strap comprising a plurality of locking tabs pivotally affixed thereto, each locking tab configured to pivot between a locked position and an unlocked position. Each locking tab is configured to pass through each channel when in an unlocked position, and each locking tab frictionally engages the interior wall of each slot when in a locked position, thereby anchoring the strap to the sole.

One object of the present invention is to provide a modular sandal having all of the advantages of customizable open toe footwear in the known art and none of the disadvantages.

Another object of the present invention is to provide a modular sandal that can be customized by the wearing by interchanging straps of varying sizes and colors.

Other objects, features, and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
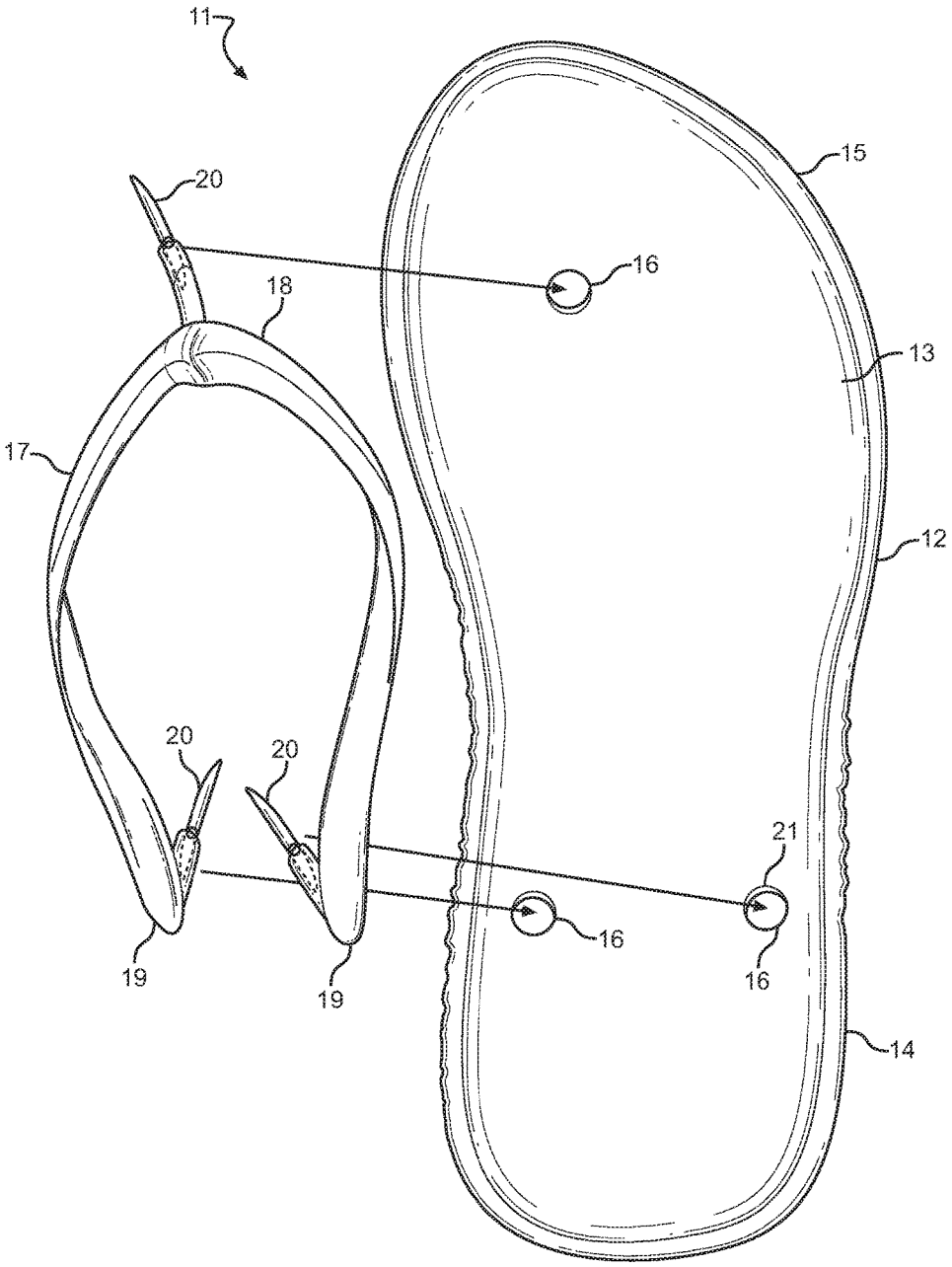
FIG. 1 shows a top view of the modular sandal.

Reference is made herein to the attached drawings. Like reference numerals are used throughout the drawings to depict like or similar elements of the modular sandal. For the purposes of presenting a brief and clear description of the present invention, the preferred embodiment will be discussed as used for providing a modular sandal with interchangeable straps. The figures are intended for representative purposes only and should not be considered to be limiting in any respect.

Referring now to FIG. 1, there is shown a top view of the modular sandal. The modular sandal 11 comprises a sole 12 having an upper side 13 and a lower side (not visible). The upper side 13 of the sole 12 receives the wearer's foot thereon. In one embodiment, the sole 12 is composed of a foam material or any other suitable material that provides comfort to the wearer. A plurality of channels 16 are disposed on the sole 12. The channels 16 extend from the lower side through to the upper side 13 of the sole 12 and are accessible via an opening 21 on the upper side 13 of the sole 12. In the illustrated embodiment, one channel 16 is disposed toward the toe end 15 of the sole 12, and another pair of channels 16 is disposed toward the heel end 14 of the sole 12.

The modular sandal 11 further includes a strap 17 that is removably securable to the sole 12. When secured to the sole 12, the strap 17 is configured to removably secure the sandal 11 to a wearer's foot when worn. In the illustrated embodiment, the strap 17 comprises a central apex portion 18 and a pair of opposing ends 19. The strap 17 can be composed of any suitably durable yet flexible material, such as plastic, fabric, or the like.

The strap 17 further includes a plurality of locking tabs 20 thereon, with one locking tab 20 disposed on the central apex portion 18, and one locking tab 20 disposed on each of the pair of opposing ends 19. The locking tabs 20 are pivotally affixed to the strap 17 and are utilized to removably secure the strap 17 to the sole 12. The locking tabs 20 are configured to pivot between a locked position and an unlocked position, and are shown in the unlocked position in FIG. 1. The locking tabs 20 are further sized such that they can freely pass through the channel 16 when in an unlocked position, and such that they cannot pass through the channel 16 when in a locked position.

Figure 2:
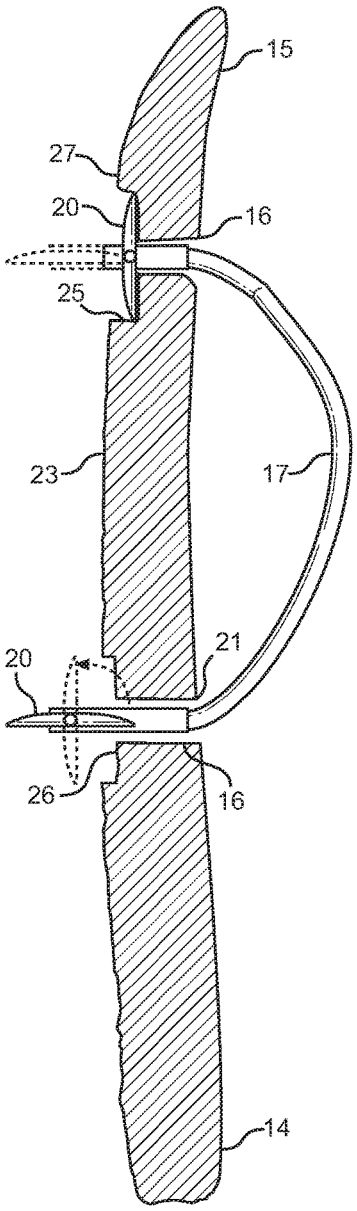
FIG. 2 shows a side view of the modular sandal.
Figure 3:
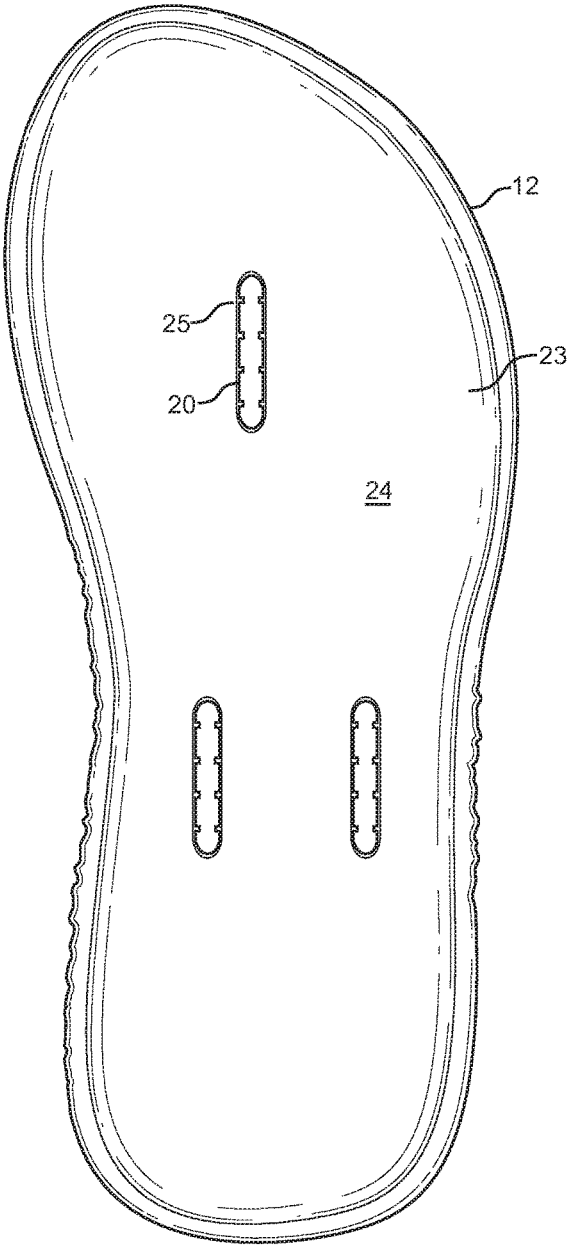
FIG. 3 shows a bottom view of the modular sandal.

Referring now to FIGS. 2 and 3, there is shown a side view of the modular sandal and a bottom view of the modular sandal, respectively. The modular sandal further includes a plurality of slots 25 disposed on the lower side 23 of the sole 12. Each channel 16 is positioned such that a lower opening 26 of the channel 16 is disposed within one of the slots 25. For example, in the illustrated embodiment, the plurality of slots 25 include one slot 25 disposed toward the toe end 15 of the sole 12 and a pair of slots 25 disposed toward the heel end 14 of the sole 12, which corresponds to the number and positioning of channels 16 shown in FIG. 1.

Each slot 25 includes interior walls 27, and the width of each slot 25 is greater than the diameter of each channel 16. In order to secure the strap 17 to the sole 12, the locking tabs 20 are pivoted to an open position and inserted through upper openings 21 of the corresponding channels 16 such that they extend out through the lower openings 26 thereof. The locking tabs 20 are then pivoted to the locked position, wherein the locking tabs 20 frictionally engage the interior walls 27 of the slots 25. When in the locked position, the locking tabs 20 are unable to be pulled back through the channels 16.

In one embodiment, when in a locked position and secured within the slots 25, the locking tabs 20 are flush with the lower surface 24 of the sole 12. Additionally, the lower surface 24 can include a non-slip material thereon, such as vulcanized rubber or the like. In order to remove the strap 17 from the sole 12 when it is secured thereto, pressure is applied to the strap 17 in the direction of the lower side 23 of the sole 12 in order to disengage the locking tabs 20 from the slots 20. The locking tabs 20 can then be rotated to an unlocked position and pulled back through the channels 16, separating the strap 17 from the sole 12. In this way, the strap 17 can be removed and replaced with a strap 17 having different colors or patterns thereon, which allows wearers to customize the appearance of their footwear as desired.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A modular sandal, comprising:

a sole including an upper side and a lower side;

a plurality of slots disposed on the lower side, each slot having an interior wall and a width;

a plurality of channels extending from an opening of the lower side through an opening of the upper side, each channel including a diameter, each channel positioned within one of the plurality of slots;

a strap comprising a plurality of locking tabs pivotally affixed thereto, each locking tab configured to pivot between a locked position and an unlocked position;

wherein each locking tab is configured to pass through each channel when in an unlocked position, and wherein each locking tab frictionally engages the interior wall of each slot when in a locked position, thereby anchoring the strap to the sole.

2. The modular sandal of claim 1, wherein the plurality of channels include a toe end channel disposed toward a toe end of the sole, and a pair of heel end channels disposed toward a heel end of the sole.

3. The modular sandal of claim 2, wherein the plurality of slots include a toe slot disposed toward the toe end of the sole, and a pair of heel end slots disposed toward the heel end of the sole.

4. The modular sandal of claim 1, wherein each locking tab is flush with a lower surface of the sole when the locking tab is in the locked position and frictionally engaged with one of the plurality of slots.

5. The modular sandal of claim 1, wherein the strap comprises a pair of opposing ends extending from an apex portion, wherein one of the plurality of locking tabs is disposed on the apex portion, and wherein one of the plurality of locking tabs is disposed on each of the opposing ends.

6. The modular sandal of claim 1, wherein the width of each of the plurality of slots is greater than the diameter of each of the plurality of channels.

7. The modular sandal of claim 1, wherein the lower side of the sole comprises a non-slip material thereon.

8. The modular sandal of claim 1, wherein the sole is composed of a foam material.

9. The modular sandal of claim 1, wherein the strap is composed of a plastic material.

10. The modular sandal of claim 1, wherein the strap is composed of a fabric material.

* * * * *